United States Patent [19]

Henderson et al.

[11] Patent Number: 4,913,221

[45] Date of Patent: Apr. 3, 1990

[54] LIQUID METAL PROCESSING

[75] Inventors: Steven Henderson, Marton; Richard B. Smith, Guisborough, both of England

[73] Assignee: British Steel plc, London, England

[21] Appl. No.: 304,652

[22] Filed: Feb. 1, 1989

[30] Foreign Application Priority Data

Feb. 4, 1988 [GB] United Kingdom ..... 8802456

[51] Int. Cl.[4] ..... B22D 11/10

[52] U.S. Cl. ..... 164/489; 164/122; 164/488; 222/590

[58] Field of Search ..... 164/122, 125, 133, 437, 164/438, 464, 465, 485, 488, 489, 900; 222/590, 592

[56] References Cited

U.S. PATENT DOCUMENTS

| | | | |
|---|---|---|---|
| 3,570,713 | 3/1971 | Tromel | 164/122 |
| 4,446,995 | 5/1984 | Wooding | 222/592 |

FOREIGN PATENT DOCUMENTS

| | | | |
|---|---|---|---|
| 2707774 | 9/1977 | Fed. Rep. of Germany | 164/437 |
| 54-137435 | 10/1979 | Japan | 164/437 |
| 57-100849 | 6/1982 | Japan | 164/437 |
| 61-235047 | 10/1986 | Japan | 164/488 |
| 2177687B | 10/1983 | United Kingdom . | |
| 2186339A | 8/1987 | United Kingdom . | |

*Primary Examiner*—Richard K. Seidel

*Attorney, Agent, or Firm*—Bacon & Thomas

[57] ABSTRACT

A method of removing heat from molten metal in which the metal is caused to flow freely within a gaseous media or vacuum over a body disposed within the metal stream such that any tendency for the metal to solidify during its passage is effective on the surface of said body against which the solidifying metal contracts into intimate contact therewith. The body may be forcibly cooled, e.g. by water. Accordingly, since the liquid metal is not enveloped by a channel or pipe, the solidifying shell tends to shrink on to the body, no gap is created, and this much higher heat transfer coefficients between the shell, the liquid metal, and the cooling body are achieved.

11 Claims, 7 Drawing Sheets

LIQUID METAL PROCESSING

Figure 1:
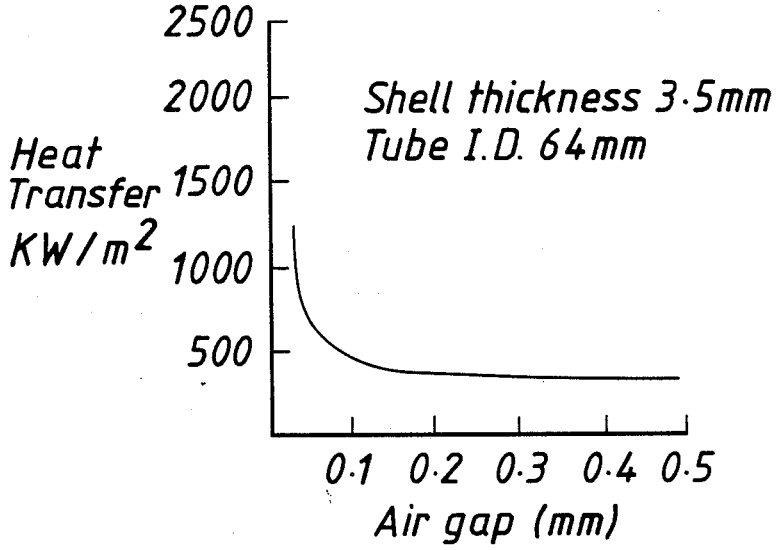

This invention relates to a method of, and apparatus for, processing liquid metal.

For many metallurgical casting processes being developed in recent years it is necessary or advantageous to deliver the liquid metal to a metal forming medium at temperatures close to or below its liquidus. Such a forming medium might be for example a casting mould, continuous casting mould or a rolling mill used for "roll casting." The advantages—operational, metallurgical and economic—of casting or forming from a low superheat stock material are well known and indeed are identified in UK patent no. 2117687 for example.

Equipment for cooling 'superheated' metals ready for forming processes is described in this UK patent, and in thi equipment the superheat, and perhaps some of the latent heat, of the liquid metal is removed during its passage through a hollow carrier through the walls of the carrier. A solid shell usually forms as the liquid metal flows across the cooled surfaces of this carrier. This shell will also in most cases form a continuous lining of the inside perimeter of the carrier which then shrinks away from the inner surface of the carrier forming a gap between it and the inner surface. The carrier itself may also expand due to an increase in its temperature further increasing the size of the air gap. For a water cooled copper carrier through which molten steel is passing the contraction of the solidified shell and expansion of the copper carrier might typically contribute to a total difference in dimensions of 0.8%. The resultant gap is a barrier to heat transfer from the processed metal to the carrier.

It is one object of this invention to mitigate this problem.

From one aspect, the present invention provides a method of removing heat from molten metal in which the metal is caused to flow freely within a gaseous media over a body disposed within the metal stream such that any tendency for the metal to solidify during its passage is effective on the surface of said body against which the solidifying metal contracts into intimate contact therewith.

Preferably an 'impact' pad is provided at the upstream end of the body and a parting spacer is provided at the downstream end to cause the reforming of a coherent stream and to facilitate ready removal of the solidified shell after each processing run; the impact pad also prevents erosion of the leading edge of the body.

The body may be shaped such that it extends in the longitudinal direction e.g. cylindrical or pear shaped in section, it may be asymmetrical or it may be symmetrical e.g. like a sphere, and the flow over the cooling body may be contained within a restricted zone e.g. by dams affixed to the body. Several of such bodies may be 'cascaded' in the direction of flow of the molten metal stream.

In accordance with this aspect of the invention since the liquid metal envelopes the cooling body the solidifying shell tends to shrink into it, no gap is created as hitherto and accordingly much higher heat transfer coefficients between the shell, and thus the liquid metal, and the cooling body are achieved. For this geometry the higher heat transfer between the solidified shell and the cooled body leads to the formation of a thicker skull which in turn leads to a greater area for heat transfer so that—assuming a constant heat transfer coefficient between the liquid and solid steel—the power output increment does not diminish with increasing heat transfer as for an 'internal' steel flow through a carrier described above.

It is however, not essential for the liquid metal to envelope the cooler, gravitational forces alone will enchance the close contact between the solidifying metal and the cooler and to this end plate-type coolers may be adopted, particularly to give larger heat transfer areas.

The body may be interposed between a melt storage vessel and a forming mechanism such as a mould or the nip of a rolling mill used for roll casting, and a distribution box may be sited between the vessel and the said body.

Preferably the body is forcibly cooled, e.g. by water.

Another object of the invention is to distribute one or more liquid metal streams into a casting mould and to do this in such a manner that the momentum with which the steel arrives in the liquid pool is minimised.

This is particularly a problem when feeding liquid steel from single nozzles to roll casting equipment where irregularities, imperfections, and breakouts can occur in the cast product. For this objective the parting spacer described above is also of benefit to promote the formation of a coherent stream leaving the unit. In this role the body over which the steam flows is either cooled or non-cooled such that although little heat is removed the liquid steel is still delivered in a distributed low momentum manner. In this instance the body might be located above the liquid metal pool or alternatively partially immersed in it. The liquid feed stream or streams may be circular or of other section, e.g. rectangular.

Again, when the body is in cylindrical form it may be designed to rotate, imparting a horizontal component of velocity to the emergent stream, eg to feed a single roll caster or a horizontal casting machine, or to induce a greater shear rate at the skull/liquid interface.

Figure 6:
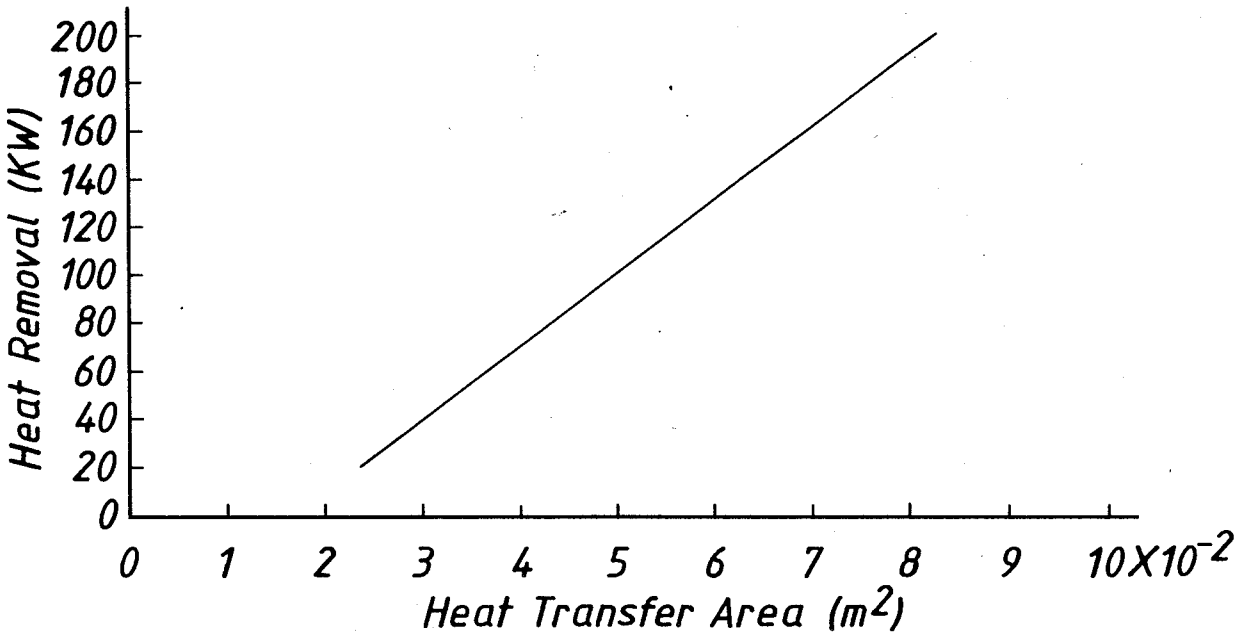
Figure 7:
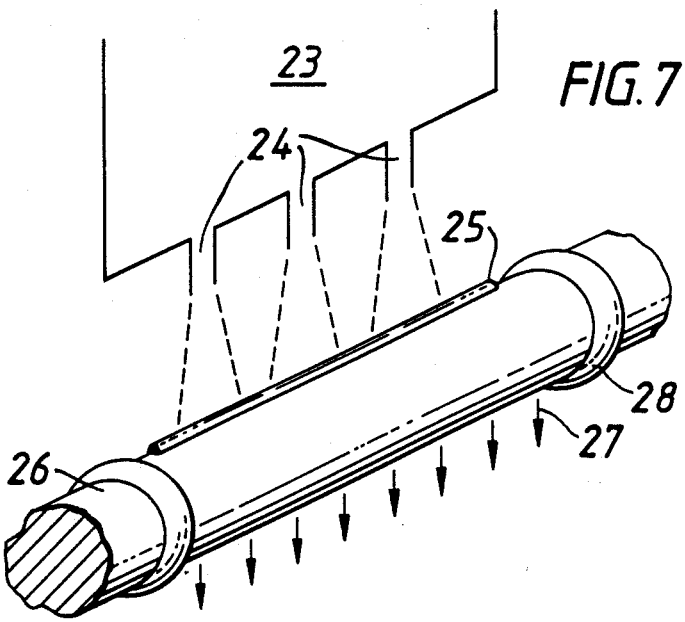
Figure 7:
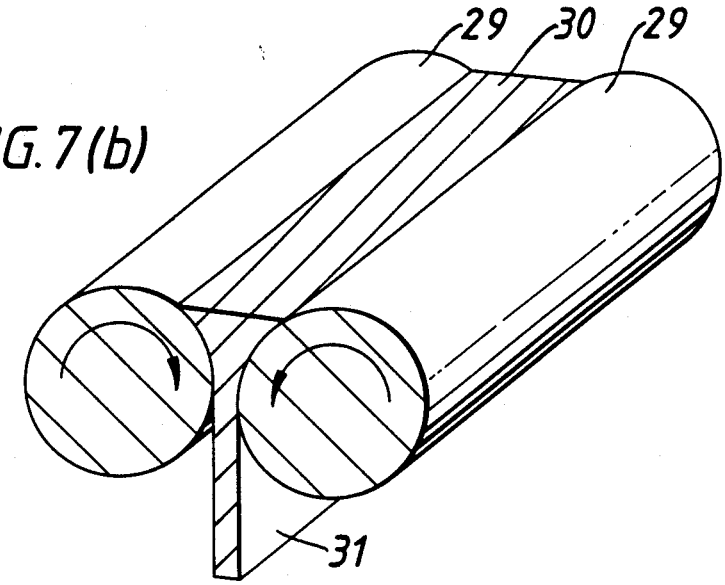

In order that the invention may be fully understood, one embodiment thereof will now be described, by way of example, with reference to the accompanying drawings, in which:

FIG. 1 graphically illustrates the effect of the gap size on heat transfer;

FIGS. 2, 3, 4 and 5 schematically illustrate various forms of apparatus for performing the method of this invention;

FIG. 6 graphically illustrates the effect of heat transfer area on the heat removal;

FIG. *7a* schematically illustrates apparatus for effecting wider distribution of the metal streams; and FIG. *7b* schematically illustrates a twin roll casting device which may typically be fed from the apparatus of FIG. *7a*.

Referring now to the drawings, FIG. 1 shows the effect of gap size on heat transfer for a water cooled copper carrier of circular section when a solidified steel shell has formed inside the carrier. From this it can be seen that minimising such a gap below a certain limit will have a dramatic effect on heat transfer. This is difficult to achieve for a metal passing through a hollow carrier since the metal is encased by the cooling medium and will tend to shrink away from it. If however, the liquid metal encases the cooling medium then any solidified shell formed will tend to shrink on to the cooling medium.

Figure 2:
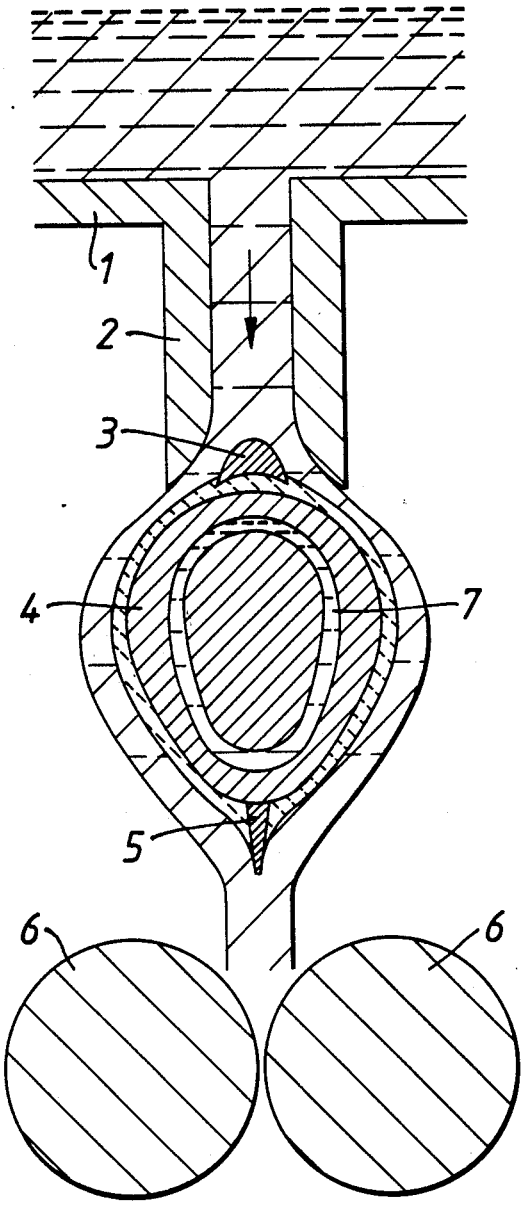

The method of removing heat at high rates from a liquid metal can be best understood by means of the apparatus shown in FIG. 2 which incorporates the principles of achieving intimate contact between the metal and the cooling medium and minimising the liquid volume to cooled surface ratio. Referring now to FIG. 2 superheated molten metal contained in vessel 1 flows through an elongated nozzle 2 on to an impact pad 3 and thence around a water-cooled copper cooler 4, the metal flowing across a shell-parting stream collecting device 5 at the downstream end of the cooler into the nip of a roll casting machine 6. The cooler is cooled by water flowing through channels 7 conveniently supplied through the ends of the body. The nozzle outlet 2 is shaped to maintain an integral consistent stream of metal against the cooler.

The stream collector device 5 serves to gather the cooled melt into a single coherent stream for supply to e.g. casting moulds or other forming mechanism. The device 5 can be designed to allow easier removal of the shell after use if desired, the shell breaking into two about the impact pad. The impact pad 3, which prevents erosion of the cooler surface, is shaped so as to ensure a smooth flow of metal on to the cooler; it may be integral with the nozzle 2 or with the cooler.

The cooler may also be tapered along an axis perpendicular to the melt flow to aid easier skull removal and/or obviate the requirement for a shell parting device.

Figure 3:
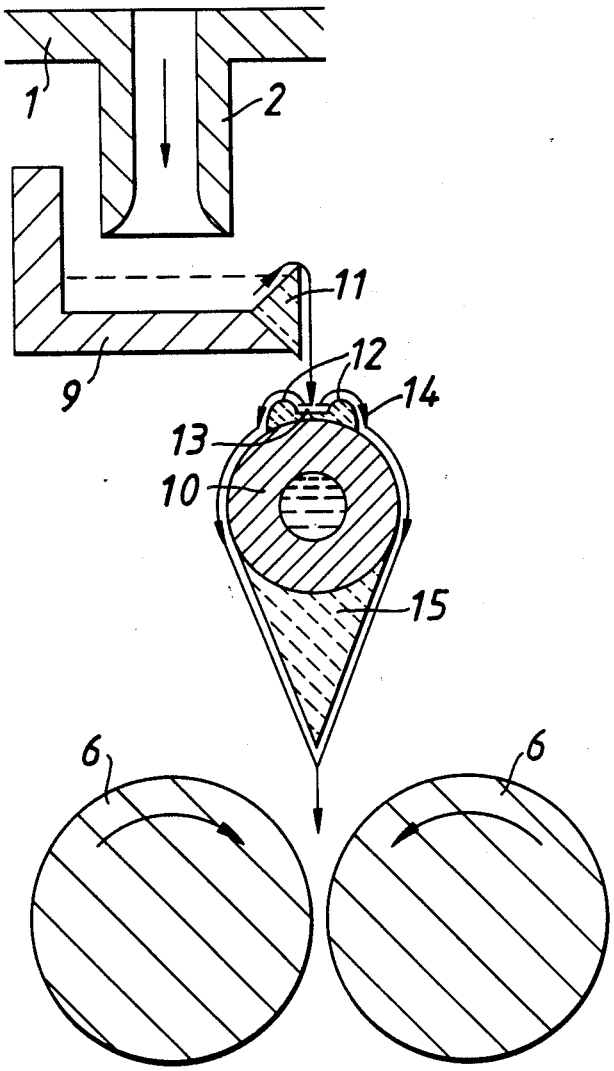

In FIG. 3, liquid metal passes from the thermally insulated vessel 1 to a distribution box 9 which serves to spread the flow along the length of the water cooled copper cooler 10. From this box the liquid metal flows over a ceramic weir 11 and falls a short distance on to the top of the cooler. Shaped refractory weirs 12 attached to the cooler ensure that the liquid streams land in a metal pool 13 and that the flow 14 which passes over the weirs and down the sides of the cooler is ordered and spread evenly over its length. Thereafter the metal flows over a refractory collecting device 15 and falls as a gathered stream into a caster 6 or other forming device as before.

Figure 4:
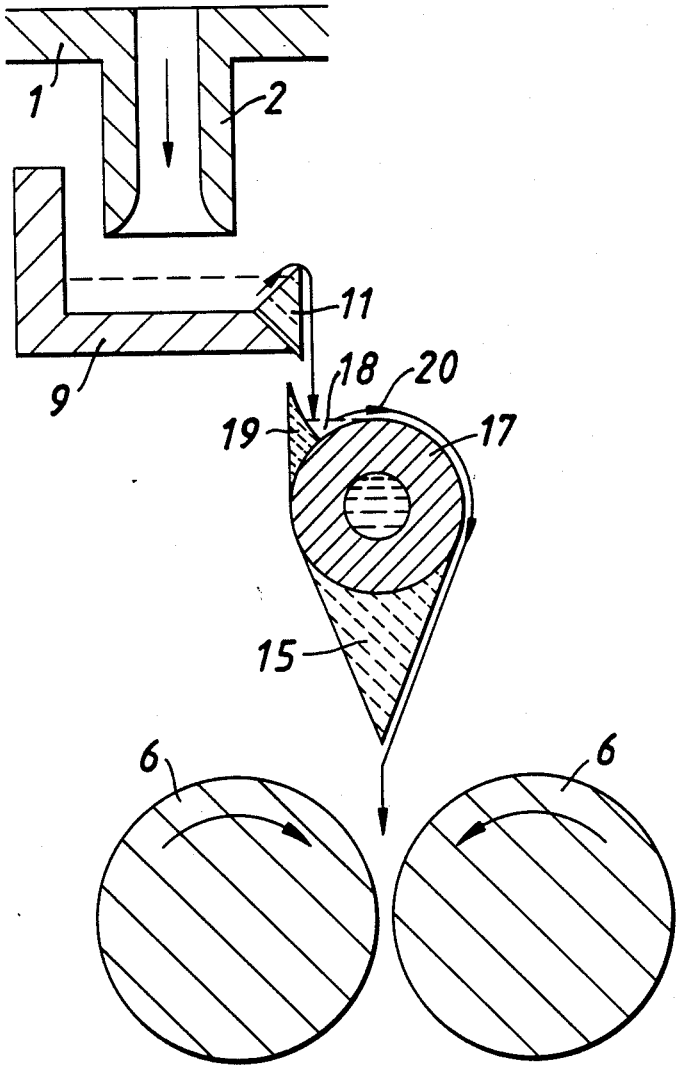

It is not essential for the molten metal to envelope the cooler and in FIG. 4, the delivery system is the same as in FIG. 3 but the cylindrical water cooled copper cooler 17 is offset so that the liquid metal falls into a pool 18 formed between a refractory dam 19 and the top of the cooler. In this case the outflow 20 is over the top of the cooler down one side only; a reduction in potential heat removal as compared with the previous embodiment is balanced by a more ordered flow off the cooler.

Figure 5:
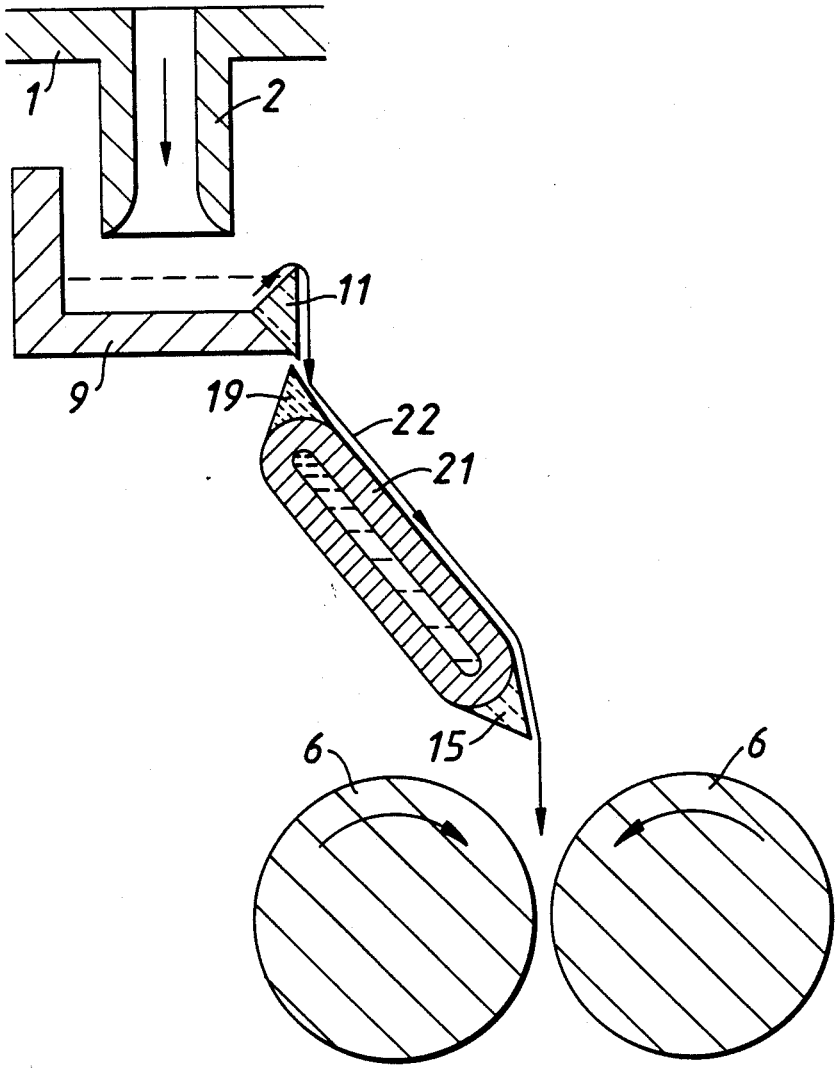

In FIG. 5 there is shown a modification of FIG. 4 in which the cylindrical water cooled copper cooler is replaced by a plate type 21. This design allows control of the thickness/velocity of the metal flow 22 over the cooler by variation of its inclination and also gives the possibility of significant increases in cooled area. The importance of this latter factor is illustrated by FIG. 6 which shows the dependence of heat removal on the area of contact between liquid metal and the cooled copper cooler surface.

The size and shape of the apparatus can readily be chosen to remove heat at specific rates for a given teeming rate, and to produce streams of desirable profile, and a multiple array of such coolers may be placed in the path of the liquid metal flow; the whole system may be enclosed in a chamber with a positive pressure of inert or inactive gas to protect the exposed surfaces of the flowing metal.

Devices may also be used to modify the flow of liquid metal over the cooler surface to perhaps make the metal flow more turbulent to improve heat transfer or to contain the metal flow in a desired path. Magnetic fields and/or electric fields may be used for this purpose. Appendages to the cooler may also serve to modify the metal flow characteristics, e.g. ribs or protrusions which might serve to further enhance heat transfer by promoting turbulent flow.

Another aspect of this invention is that the cooler can be used singly or in combination with other identical, similar or compatible coolers to slow down and distribute the flow of a liquid metal providing a uniform low velocity feed of liquid metal to the casting mould or forming process. In this embodiment the cooler may be replaced by a non-cooling body so that little or no heat is removed from the liquid but it is delivered in a diffused but coherent stream.

In this regard reference is now made to FIG. *7a*. Superheated metal is contained in vessel 23 and flows through discharge nozzles 24 on to an impact pad 25 and thence around the body 26. As the metal stream flows over this body it is distributed longtudinally and leaves as a coherent film. The stream collector device 27 serves to promote the formation of the coherent stream leaving the unit and dams 28 serve to contain the liquid stream.

FIG. *7b* shows a typical horizontally—disposed twin roll casting mill. The two rolls 29 are shown and within the nip of the rolling mill there is a pool of metal 30; the cast product 31 is shown emerging from the mill. To simplify the drawing the devices used to contain the liquid pool at the ends of the rolls are not shown in this instance.

In practice the FIG. *7a* apparatus would be disposed just above the metal pool 30 in the nip or alternatively partially immersed in it. As shown the device is uncooled its role being just to distribute the metal feed. However it may readily be used with a cooled body such as to achieve the dual benefits of distribution and a metal feed close to or below its liquidus.

We claim:

1. A method of removing heat from molten metal comprising causing the metal to flow freely within a gaseous media or vacuum over a generally cylindrical shaped body disposed in the path of the metal stream such that any tendency for the metal to solidify during its passage is effective on the surface of said body against which the solidifying metal contracts into intimate contact therewith.

2. A method according to claim 1, in which the body is water-cooled.

3. A method according to claim 2, in which the molten metal is discharged from a storage vessel on to the said body via an intermediate distribution vessel, the metal overflowing a weir thereon.

4. A method according to claim 3, in which the molten metal substantially wholly envelopes the cylindrical surface.

5. A method according to claim 4, in which an impact pad is provided on the body on the upstream side, and a reforming member is provided on the downstream side, said member promoting a coherent stream and facilitating ready removal of the solidified shell on completion of a processing run.

6. A method according to claim 4 in which the body is rotatable.

7. A method according to claim 3, in which the metal is caused to flow over one half only of the cylindrical surface.

8. A method according to claim 7, further comprising feeding the metal stream issuing from the downstream side of said body into a forming mechanism.

9. A method according to claim 8, further comprising reducing the momentum of the molten metal entering the forming mechanism.

10. A method according to claim 8, in which the metal stream issuing from the downstream side of the said body is fed into a mould or the nip of a rolling mill for roll casting.

11. A method of removing heat from molten metal comprising discharging molten metal from a storage vessel into an intermediate distribution vessel, causing the metal to flow freely from the intermediate distribution vessel with a gaseous media or vacuum over one half of a generally cylindrical-section water-cooled body disposed in the path of the metal stream such that any tendency for the metal to solidify during its passage is effective on the surface of said body against which the solidifying metal contracts into intimate contact therewith, and feeding the metal stream issuing from the downstream said of said body into a mould or the nip of a rolling mill for flow casting.

* * * * *